US007381137B2

(12) United States Patent
Steele et al.

(10) Patent No.: US 7,381,137 B2
(45) Date of Patent: Jun. 3, 2008

(54) ZIPLINE BRAKING AND MOTION-ARREST SYSTEM

(75) Inventors: Robert L. Steele, Winnipeg (CA); Charles Z. Steele, Whistler (CA); David E. Udow, Whistler (CA)

(73) Assignee: Ziptrek Ecotours, Inc., Whistler, British Columbia (CA)

( * ) Notice: Subject to any disclaimer, the term of this patent is extended or adjusted under 35 U.S.C. 154(b) by 349 days.

(21) Appl. No.: 11/055,071

(22) Filed: Feb. 11, 2005

(65) Prior Publication Data

US 2006/0027134 A1 Feb. 9, 2006

(30) Foreign Application Priority Data

Jul. 2, 2004 (CA) ..... 2472784

(51) Int. Cl.
*A63G 21/20* (2006.01)

(52) U.S. Cl. ..... 472/45; 472/50; 104/113

(58) Field of Classification Search ..... 472/43, 472/45, 2, 136, 137, 49, 50; 104/53, 113; 182/11, 72
See application file for complete search history.

(56) References Cited

U.S. PATENT DOCUMENTS 3,827,368 A * 8/1974 Garnier ..... 104/112
4,934,277 A * 6/1990 Smith et al. ..... 104/113
4,961,385 A * 10/1990 Abouzakhm ..... 104/113
5,224,425 A * 7/1993 Remington ..... 104/53
6,666,773 B1 12/2003 Richardson
2002/0162477 A1 11/2002 Palumbo

FOREIGN PATENT DOCUMENTS

WO WO 2004/035164 4/2004

OTHER PUBLICATIONS

"Vacationers to Costa Rica should check first with their tour operators' lawyers" by Gary Stix, Scientific American, Mar. 22, 2004.

* cited by examiner

*Primary Examiner*—Kien Nguyen
(74) *Attorney, Agent, or Firm*—Oyen Wiggs Green & Mutala LLP

(57) ABSTRACT

Braking and motion-arrest apparatus for braking the arrival of a zipline cable rider at a landing platform and arresting the rider's motion to retain the rider at the platform. A frame is mounted on the cable to allow longitudinal rolling movement of the frame along the cable. A self-closing one-way latch is provided at the forward end of the frame. The latch includes a pair of capture plates which are normally inwardly biased toward one another, on opposite sides of the cable. The rider is tethered to a pulley block which rolls along the cable and collides with the latch. The collision force drives the plates laterally away from the cable, allowing the pulley block to roll through the latch. After the pulley block rolls past the latch, the plates' normal biasing closes the latch, preventing the pulley block from rolling back through the latch.

24 Claims, 8 Drawing Sheets

ZIPLINE BRAKING AND MOTION-ARREST SYSTEM

TECHNICAL FIELD

This invention relates to a zipline braking system for braking the arrival of a zipline rider at a landing platform and arresting the rider's motion to retain the rider at the landing platform.

BACKGROUND

"Ziplines" are gravity-based cable rides generally used to transport people for various purposes including recreational thrill rides, forest canopy tours, challenge courses and rescue operations. A typical zipline includes a stranded steel wire cable or fibre rope suspended between two supports, platforms at each support for launching and landing riders, pulley blocks and harnesses to support and transport riders along the cable.

For example, FIG. 1 depicts a zipline system in which wire rope main cable 4 is suspended between supports 1A, 1B which may be constructed of wood, steel, aluminum or any other structurally suitable material. Trees or boulders may alternatively function as supports 1A, 1B. A launch platform 2A is constructed on or surrounding support 1A, and a landing platform 2B is constructed on or surrounding support 1B. Either or both of platforms 2A, 2B may be (and typically are) fixed or mounted at elevated locations on supports 1A, 1B respectively. Each platform 2A, 2B is equipped with a ramp or steps 3A, 3B respectively to assist in launching and landing of riders as explained below. Although not shown, platforms 2A, 2B are typically also equipped with suitable safety railings and access control gates. Platforms 2A, 2B may be suspended relative to supports 1A, 1B to facilitate raising or lowering of platforms 2A, 2B (e.g. via suitable motorized winches) in order to periodically adjust the tension of cable 4.

Rider 7 begins by donning a harness 6 supplied by the zipline operator. Harness 6 includes a short tether which is securely fastened to a pulley block 5. After donning harness 6, rider 7 ascends to launch platform 2A, where the zipline operator's personnel couple pulley block 5 to cable 4, such that pulley block 5 will roll smoothly along cable 4. Rider 7 descends launch steps 3A and is released under the control of the zipline operator's personnel. More particularly, pulley block 5 rolls along cable 4 toward landing platform 2B (i.e. from right to left as viewed in FIG. 1) with rider 7 suspended beneath cable 4 by harness 6.

Rider 7 must reach and be braked and arrested at landing platform 2B. If rider 7 is not properly braked upon arrival at landing platform 2B, the moving rider may collide with support 1B, with landing platform 2B or with persons or objects on landing platform 2B. If rider 7's motion is not properly arrested upon arrival at landing platform 2B, rider 7 may roll back down to the nadir of cable 4. Similarly, if rider 7 is not carried along cable 4 with sufficient velocity, rider 7 may slow down, stop short of landing platform 2B, and roll back down to the nadir of cable 4. In either case, the zipline operator's personnel must rescue rider 7 from the nadir of cable 4. The rescue technique is well known and straightforward, and need not be described here. But, to avoid potentially time-consuming and somewhat labour intensive rescue operations, the slope of cable 4 (the vertical distance between platforms 2A, 2B), the cable's sag (the vertical distance between cable 4 at mid-span and a chord drawn between supports 1A, 1B) and the cable's tension are preferably adjusted to achieve a reasonable transit time at sufficient velocity along cable 4 to enable rider 7 to reach landing platform 2B.

The prior art has evolved various zipline braking and motion-arrest techniques. In some cases (e.g. if the landing platform is between the supports, at the nadir of the cable) no braking system is needed-the rider is intentionally allowed to roll back down to and stop at the nadir of the cable, and dismounts there. Another brakeless technique requires the zipline operator's personnel to physically catch and hold the rider upon arrival at the landing platform. Some zipline operators attach a second "tag line" cable, separate from the main zipline cable, to the rider's support pulley block, for braking purposes. Other operators provide automatic and/or rider-controlled brakes.

This invention provides a braking system for braking a zipline rider upon arrival at a landing platform, for arresting the rider's motion to retain the rider at the landing platform and for hauling the rider up to the landing platform. Besides enhancing safety, this allows the zipline operator's personnel to deal with other zipline operational aspects.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the present invention. Accordingly, the specification and drawings are to be regarded in an illustrative, rather than in a restrictive sense. As used herein and as indicated by double-headed arrows in FIGS. 2, 4A and 5, "rearward," "rearwardly," "rearwardmost" and "forward," "forwardly," "forwardmost" mean directions which are respectively longitudinally closer to and farther from a landing platform approached by a rider traversing cable 4. "Inward" and "outward" mean directions which are respectively laterally closer to and farther from cable 4.

Figure 1:
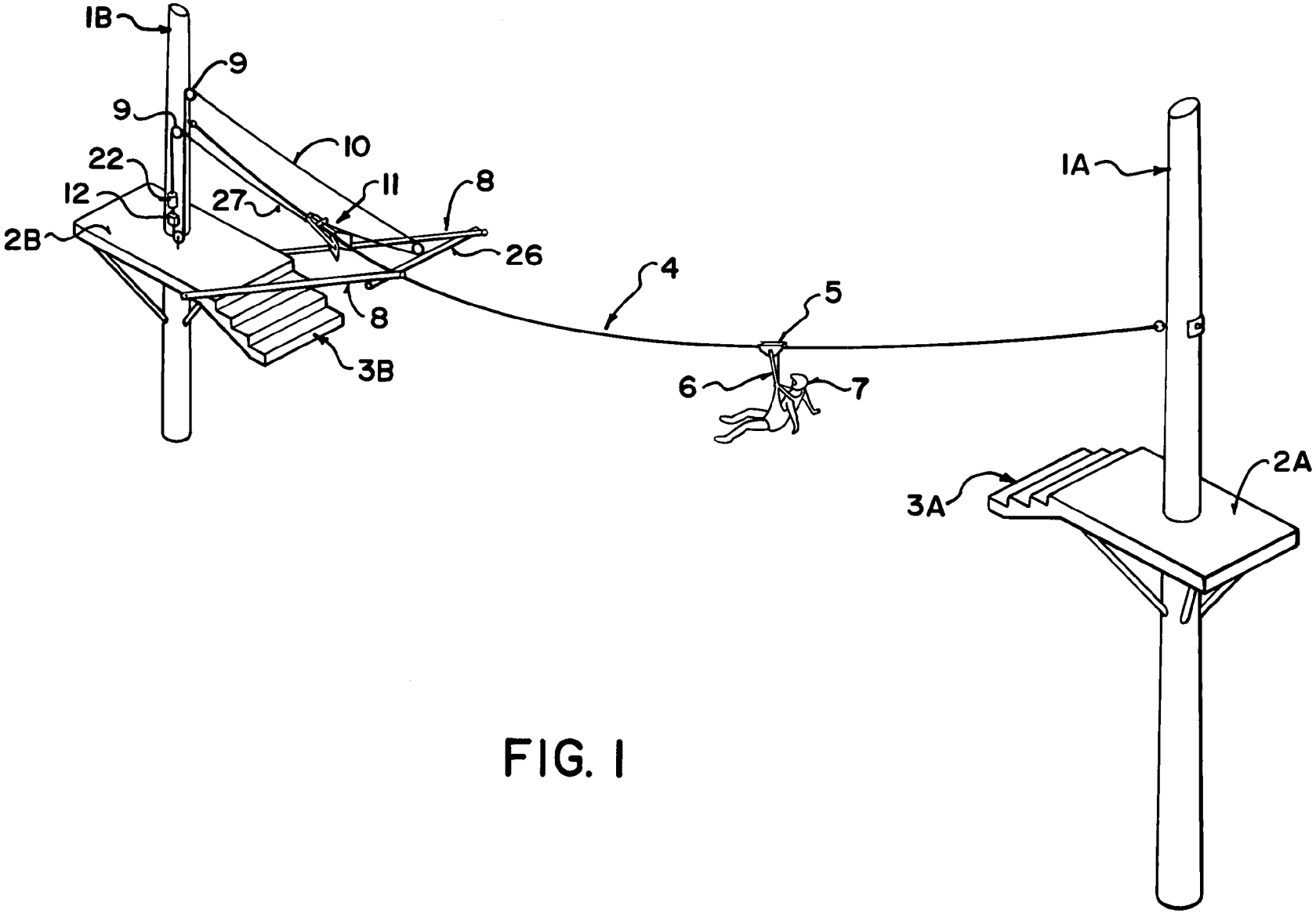
FIG. 1 is an isometric view of a zipline showing the supports, the launch and landing platforms, the main cable and a braking system in accordance with the invention.
Figure 2:
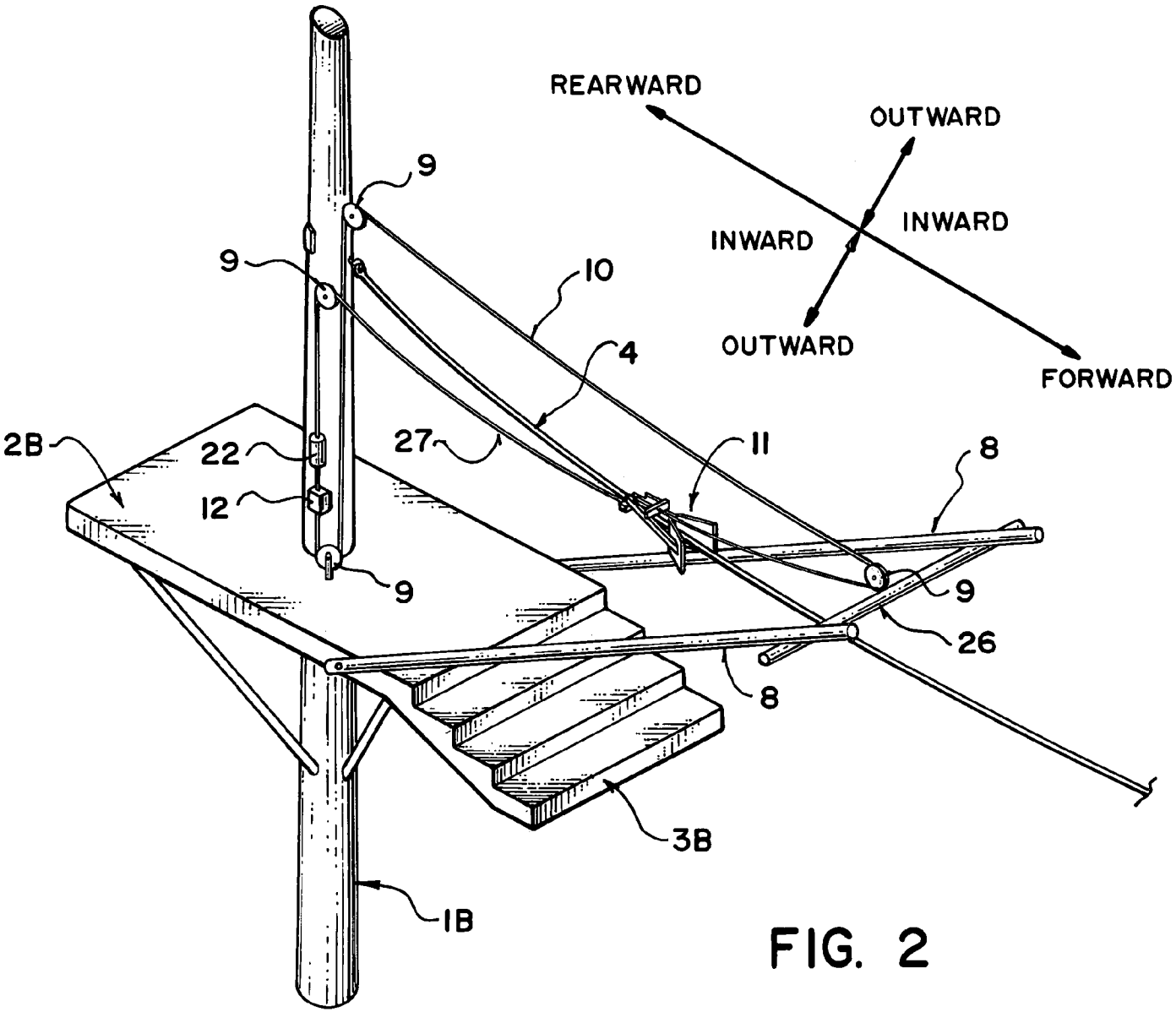
FIG. 2 is an isometric view of the landing platform showing the relationship between the braking block on the main cable, the structure supporting the brake line pulley, the braking device on the support tower, the anti-rollback device on the support tower and the haul-up line.
Figure 3:
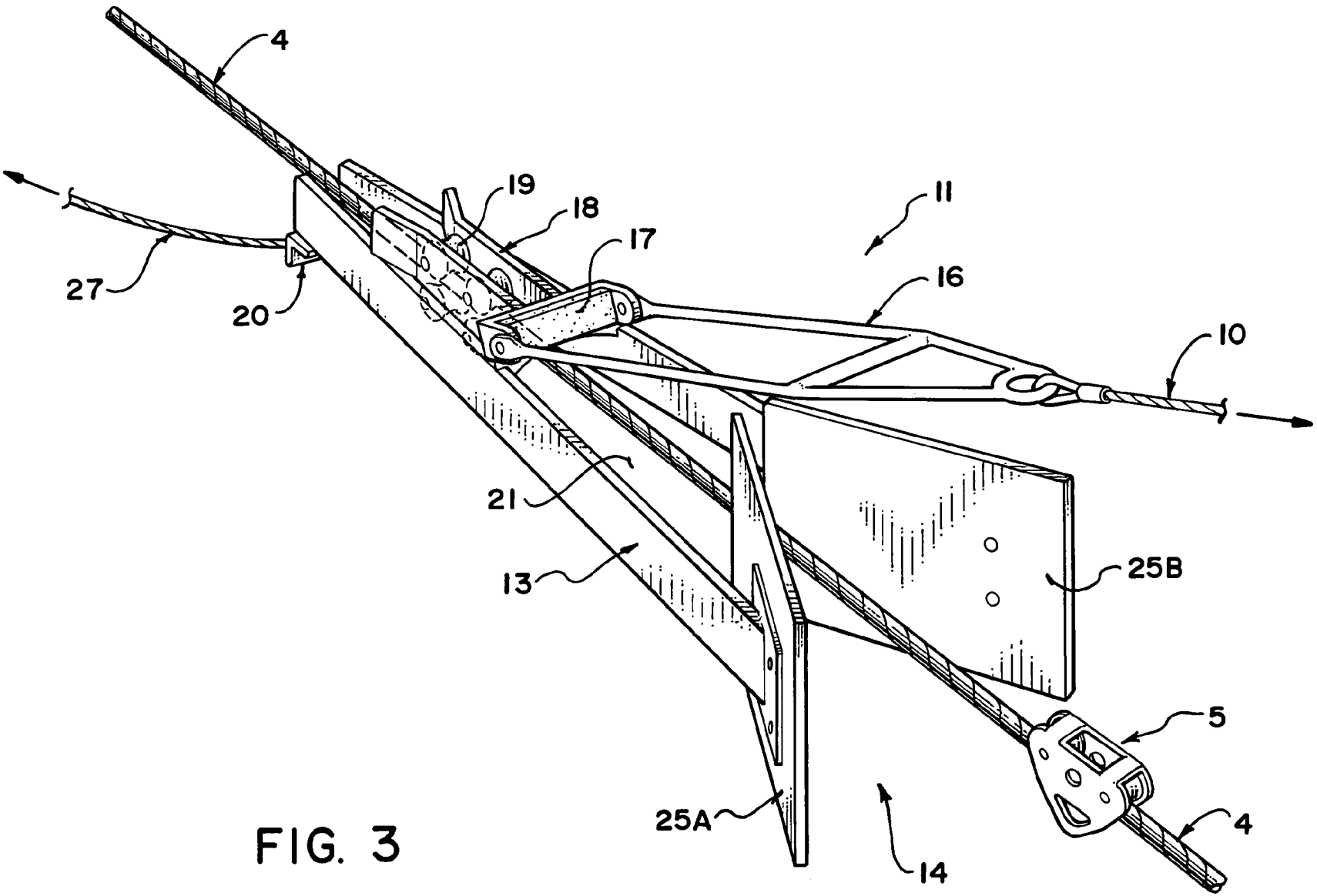
FIG. 3 is a detailed isometric view of a braking block in accordance with a first embodiment of the invention.

FIGS. 1, 2 and 3 depict an embodiment of the invention, including braking block 11, installed at the previously-described landing platform 2B. As best seen in FIG. 3, four pulleys 19 are rotatably mounted within a first frame 18 formed of a pair of spaced-apart metal plates. Two of pulleys 19 are longitudinally aligned to rotatably engage main cable 4 from above. The other two of pulleys 19 are longitudinally aligned to rotatably engage the underside of cable 4. (In some cases in may be sufficient to provide only three pulleys 19, with two pulleys engaging cable 4 from above and the third pulley engaging the underside of cable 4.) First frame 18 is welded or otherwise suitably fastened to a second metal plate frame 13, which forms a "V" longitudinally aligned with and straddling cable 4, the narrow, rearward end of the "V" being located closest to support 1B. Pulleys 19 permit longitudinal rolling movement of braking block 11 (which incorporates frames 18, 13) in either direction along cable 4.

Resilient (e.g. urethane-lined) bumper block 17 is mounted on second frame 13, forwardly of first frame 18 and above cable 4. Bail 16 couples bumper block 17 to braking line 10, which is routed through a system of pulleys 9 to braking device 12 and to anti-rollback device 22 fixed on support 1B. A pair of struts 8 are pivotally attached to opposed sides of landing platform 2B. Crossbar 26 extends between the forward ends of struts 8, above main cable 4 and forwardly of braking block 11. One of pulleys 9 is rotatably mounted on crossbar 26. The remaining pulleys 9 are rotatably mounted on support 1B. Bracket 20 is welded or otherwise suitably fastened to the narrow "V" end of second frame 13, beneath cable 4, to provide a connecting point for haul-up line 27. Braking device 12 may be a belaying device of the type commonly used by mountain climbers, or any one of a brake lever, a drum brake, or brake caliper. In some cases there may be no braking device per se, for example if the force exerted by a human manipulating braking line 10 and haul-up line 27 is sufficient to brake rider 7 to a stop. Anti-rollback device 22 may be a cam cleat of the type commonly used to secure ropes on pleasure boats or a self-jamming pulley such as those available from PETZL™ America of Clearfield, Utah under the trademarks Pro-Traxion™ or Mini-Traxion™.

A self-closing, one-way latch 14 is provided at the wider, open forward end of second frame 13 to form a corral 21 within second frame 13 between bumper 17 and latch 14. Latch 14 may be formed by fixing a pair of flexible, first and second capture plates 25A, 25B at the wider, open forward end of second frame 13, such that plates 25A, 25B form another "V" longitudinally aligned with and straddling cable 4, the narrow, rearward end of the "V" again being located closest to support 1B. Because capture plates 25A, 25B are formed of a flexible material (e.g. plastic or another suitable flexible material) the rearward ends of plates 25A, 25B are inherently inwardly biased toward one another, on opposite sides of cable 4. Alternatively, self-closing one-way latch 14 may be formed by providing a pair of hinged and/or spring-biased plates at the wider, open end of second frame 13 (in which case plates 25A, 25B need not be flexible).

Care is taken to dimension the above-described components of braking block 11 so that the overall centre of gravity of braking block 11 is below main cable 4.

In operation of the embodiment of FIGS. 1, 2 and 3, rider 7's pulley block 5 rolls rearwardly along cable 4 and collides with latch 14. The collision force drives (i.e. bends or deforms) flexible plates 25A, 25B outwardly away from cable 4, allowing pulley block 5 to roll through latch 14 into corral 21. As soon as pulley block 5 rolls past the rearwardmost ends of plates 25A, 25B those plates flex back into their original position, closing latch 14 upon cable 4 and thereby preventing pulley block 5 from rolling forwardly back through latch 14. After rolling past the rearwardmost ends of plates 25A, 25B as aforesaid, pulley block 5 continues rolling rearwardly along cable 4, through corral 21, until pulley block 5 collides with bumper block 17. The latter collision stops rider 7 by transferring the rider's kinetic energy through bumper block 17, bail 16 and braking line 10 to braking device 12.

The zipline operator's personnel manipulate braking line 10 and haul-up line 27 to brake rider 7 to a stop and manoeuver rider 7 onto landing platform 2B. For example, after coming to a stop, rider 7 may be unable to reach steps 3B on landing platform 2B, in which case the zipline operator's personnel manipulate haul-up line 27 to haul braking block 11 rearwardly along cable 4 toward support 1B. Since the rider's pulley block 5 is captured within braking block 11, such action simultaneously hauls the rider's pulley block 5 and the harness-suspended rider along cable 4 toward support 1B, and is continued until the rider reaches a secure dismount position relative to landing platform 2B at which pulley block 5 can be decoupled from cable 4. During this procedure, the need for the operator's personnel to maintain continuous force on haul-up line 27 to prevent rider 7 and braking block 11 from rolling back down main cable 4 is obviated by anti-rollback device 22.

Figure 4A:
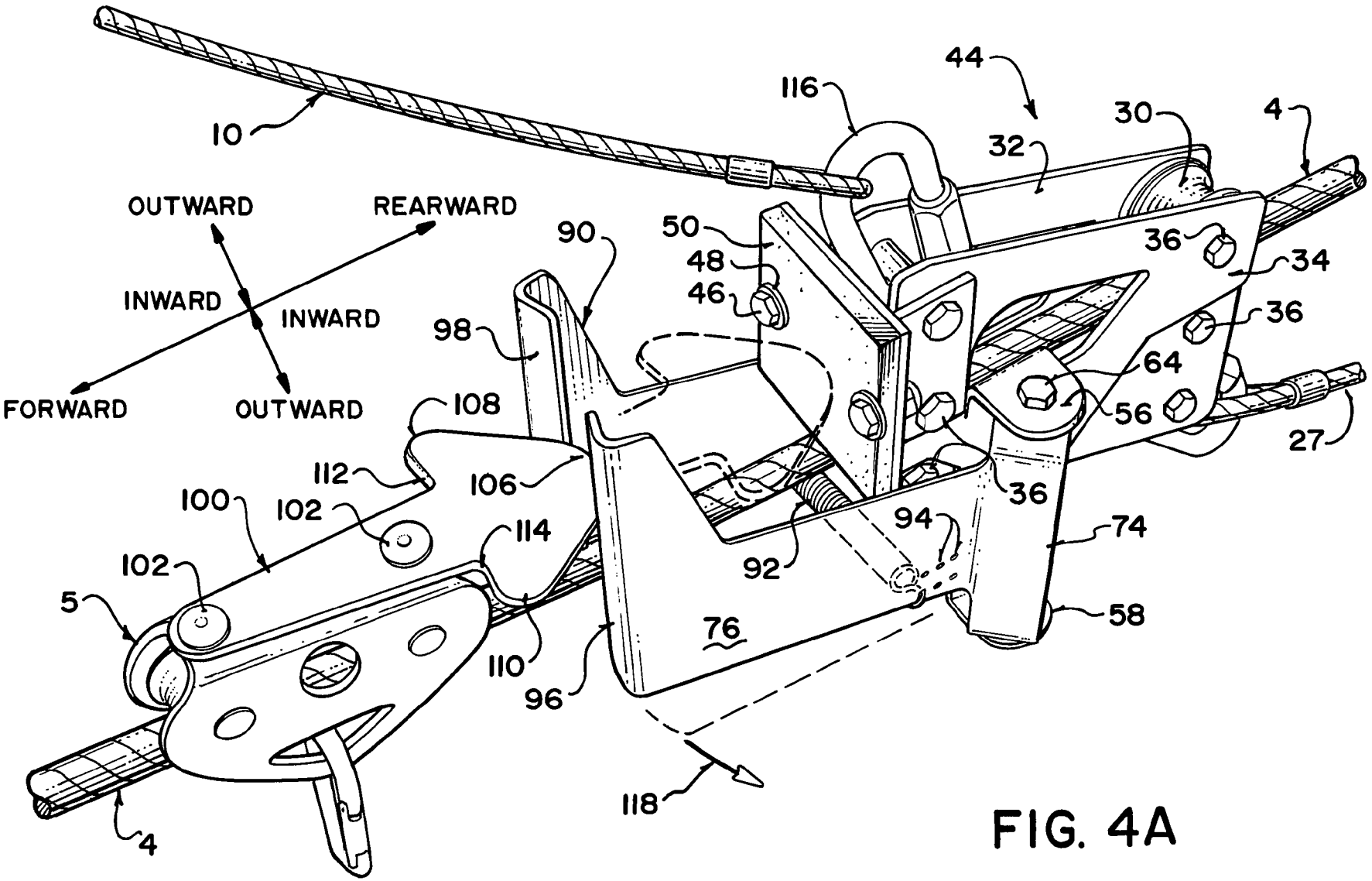
FIG. 4A is an isometric view of a braking block in accordance with a second embodiment of the invention, showing a pulley block about to latchingly engage the braking block.
Figure 4B:
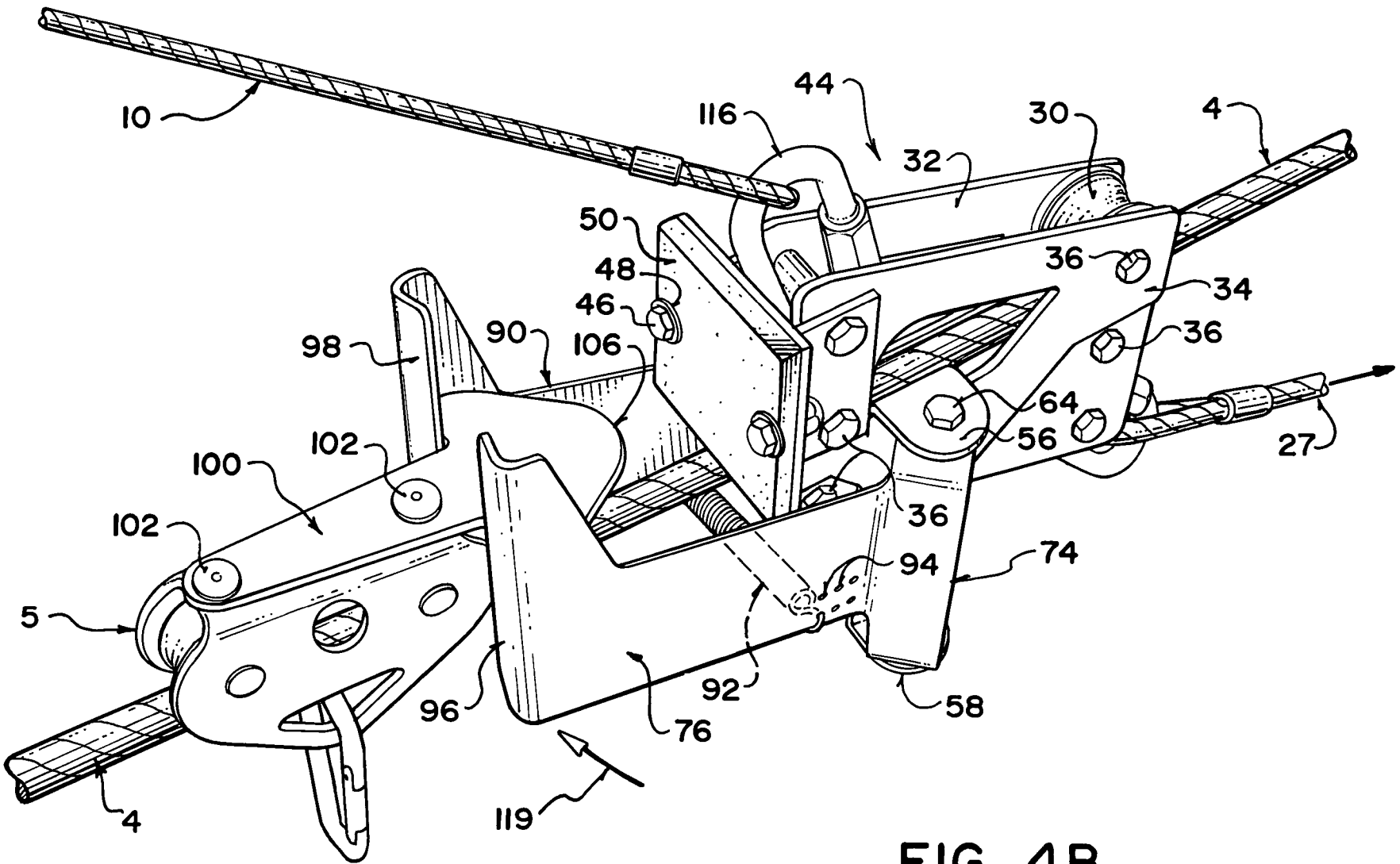
FIG. 4B depicts the FIG. 4A apparatus after the pulley block latchingly engages the braking block.

FIGS. 4A and 4B depict an alternate embodiment of the invention in which four pulleys 30 are rotatably mounted between metal plates 32, 34 with the aid of axle bolts 36 to form a braking block frame 44. More particularly, two of pulleys 30 are longitudinally aligned to rotatably engage main cable 4 from above and another two of pulleys 30 (not shown) are longitudinally aligned to rotatably engage the underside of cable 4. (In some cases in may be sufficient to provide only three pulleys 30, with two pulleys engaging cable 4 from above and the third pulley engaging the underside of cable 4.) Pulleys 30 permit longitudinal rolling movement of braking block frame 44 in either direction along cable 4.

Machine screws or bolts 46 and washers 48 fasten resilient (e.g. urethane) bumper block 50 to bars 52, 54 which are respectively attached (e.g. welded or otherwise suitably fastened) to the forward ends of plates 32, 34 respectively, above cable 4. A first pair of spaced-apart, vertically aligned flanges 56, 58 are attached (e.g. welded or otherwise suitably fastened) to the outward side of plate 34. A second pair of spaced-apart, vertically aligned flanges (not visible in FIGS. 4A, 4B) are formed or attached (e.g. welded or otherwise suitably fastened) to the outward side of plate 32. Bolts 64 pivotally connect inwardly angled flange 74 provided on the rearward end of first capture plate 76 between flanges 56, 58 on one side of cable 4. Although not visible in FIG. 4A or 4B, a similar arrangement is provided on the opposite side of cable 4 to pivotally connect second capture plate 90 between the vertically aligned flanges provided on plate 32. Spring 92 is connected in tension between a selected pair of apertures 94 provided in each of capture plates 76, 90 to normally bias plates 76, 90 inwardly toward one another on opposite sides of cable 4. The biasing force can be selectably adjusted by reconnecting spring 92 between a different selected pair of apertures 94. If desired, more than one spring can be connected between selected pairs of apertures 94.

Capture plates 76, 90 have inwardly extending forward ends 96, 98 respectively, which spring 92 normally biases inwardly toward one another on opposite sides of cable 4. When viewed from above, capture plates 76, 90 accordingly form a "V" longitudinally aligned with and straddling cable 4, the "V" having a narrow forward end and a wide rearward end, with the wide rearward end of the "V" located closer to the landing platform than the narrow forward end of the "V". Care is taken to dimension the above-described components of braking block frame 44 and capture plates 76, 90 so that the overall centre of gravity of braking block frame 44 is below main cable 4.

Latch plate 100 is fastened atop pulley block 5 by rivets 102. Plate 100 is rearwardly tapered toward its rearward end 106 (i.e. the end of plate 100 closest to braking block frame 44). Outwardly extending flanges 108, 110 are provided on the outward sides of plate 100 to define opposed notches 112, 114 on the respective outward sides of plate 100. Shackle 116 connects one end of braking line 10 to the upper, forward ends of braking block frame 44. As in the case of the embodiment of FIGS. 1, 2 and 3, braking line 10 is routed through the aforementioned system of pulleys 9 to braking device 12 and to anti-rollback device 22 fixed on support 1B.

In operation of the FIG. 4A and 4B embodiment, rider 7's pulley block 5 rolls along cable 4 until latch plate 100's tapered rearward end 106 collides with the inwardly biased forward ends 96, 98 of capture plates 76, 90. The collision position of latch plate 100 is shown in solid lines in FIG. 4A. The collision force overcomes the tension of spring (or springs) 92 and drives capture plates 76, 90 outwardly away from cable 4 as indicated by arrow 118, allowing pulley block 5 and latch plate 100 to roll rearwardly of the forward ends 96, 98 of capture plates 76, 90. As soon as the forwardmost portions of flanges 108, 110 are carried rearwardly of the inwardly biased forward ends 96, 98 of capture plates 76, 90 spring 92 draws capture plates 76, 90 inwardly toward cable 4 as indicated by arrow 119 (FIG. 4B), positioning forward ends 96, 98 of capture plates 76, 90 forwardly of notches 112, 114 respectively. Any subsequent forward motion of pulley block 5 along cable 4 accordingly engages forward ends 96, 98 within notches 112, 114 preventing further forward motion of pulley block 5 and rider 7 along cable 4. Capture plates 76, 90 and spring 92 thus form a self-closing one-way latch which, when closed upon latch plate 100 as aforesaid, prevents pulley block 5 from rolling forwardly along cable 4.

After rolling past forward ends 96, 98 of capture plates 76, 90 as aforesaid, pulley block 5 continues rolling rearwardly along cable 4, until pulley block 5 collides with bumper block 50 (i.e. latch plate 100 is carried by pulley block 5 into the position shown in dashed lines in FIG. 4A). The latter collision stops rider 7 by transferring the rider's kinetic energy through bumper block 50 and braking line 10 to braking device 12. The zipline operator's personnel then manipulate braking line 10 and haul-up line 27 to brake rider 7 to a stop and manoeuver rider 7 onto landing platform 2B as previously explained.

Figure 5:
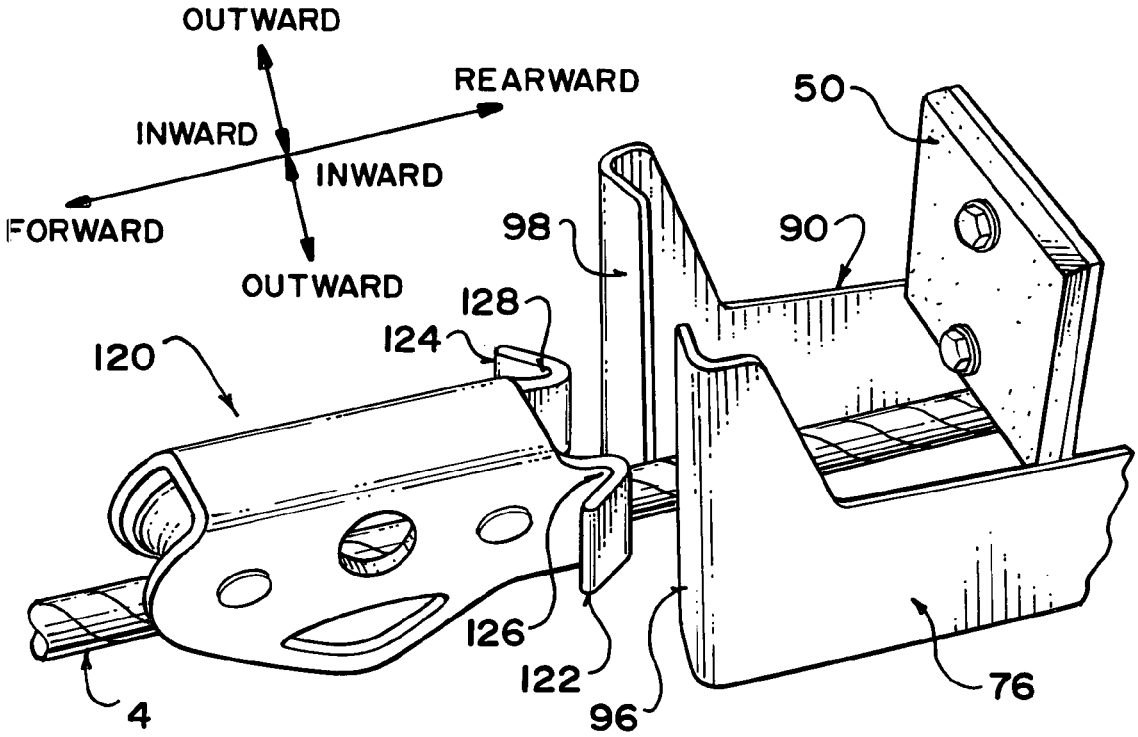
FIG. 5 is an isometric view depicting an alternate pulley block for latchingly engaging the braking block shown in FIGS. 4A and 4B.

FIG. 5 depicts an alternate pulley block 120 for latchingly engaging the braking block shown in FIGS. 4A and 4B. Rearwardly and outwardly extending hook plates 122, 124 are provided on the outward sides of pulley block 120 to define opposed notches 126, 128 on the respective outward sides of pulley block 120. In operation of the FIG. 5 embodiment, pulley block 120 rolls rearwardly along cable 4 until the rearwardmost ends of hook plates 122, 124 collide with the inwardly biased forward ends 96, 98 of capture plates 76, 90. The collision force overcomes the tension of spring (or springs) 92 and drives capture plates 76, 90 outwardly away from cable 4, allowing pulley block 120 to roll rearwardly of the forward ends 96, 98 of capture plates 76, 90. As soon as the opposed outward ends of hook plates 122, 124 are carried rearwardly of the inwardly biased forward ends 96, 98 of capture plates 76, 90 spring 92 draws capture plates 76, 90 inwardly toward cable 4, positioning forward ends 96, 98 of capture plates 76, 90 forwardly of notches 126, 128 respectively. Any subsequent forward motion of pulley block 120 along cable 4 accordingly engages forward ends 96, 98 within notches 126, 128 preventing further forward motion of pulley block 120 and rider 7 along cable 4. Capture plates 76, 90 and spring 92 thus form a self-closing one-way latch which, when closed upon pulley block 120 as aforesaid, prevents pulley block 120 from rolling forwardly along cable 4. After rolling past forward ends 96, 98 of capture plates 76, 90 as aforesaid, pulley block 120 continues rolling rearwardly along cable 4, until pulley block 120 collides with bumper block 50. The latter collision stops rider 7 by transferring the rider's kinetic energy through bumper block 50 and braking line 10 to braking device 12. The zipline operator's personnel then manipulate braking line 10 and haul-up line 27 to brake rider 7 to a stop and manoeuver rider 7 onto landing platform 2B as previously explained.

FIGS. 6A, 6B, 7 and 8 respectively depict third, fourth and fifth embodiments of the invention. In the FIG. 6A embodiment, a pair of spaced-apart plates 130, 132 are rollably supported on opposite sides of cable 4 by pulleys to form a braking block. The opposed legs 134, 136 of U-shaped bracket 138 are fastened to plates 130, 132 respectively with the bracket's bar 140 projecting forwardly of the braking block, between legs 134, 136. Hook 142 is pivotally fastened to and projects rearwardly from pulley block 5. The weight of hook 142 downwardly biases hook 142 about its point of pivotal connection to pulley block 5. Alternatively, a spring (not shown) may be coupled between pulley block 5 and hook 142 to downwardly bias hook 142 about its point of pivotal connection to pulley block 5. In operation of the FIG. 6A embodiment, pulley block 5 rolls rearwardly along cable 4 until hook 142's downwardly biased, tapered rearward underside 144 collides with bar 140. The collision force overcomes hook 142's downward bias, pivoting hook 142 upwardly and allowing pulley block 5 to continue rolling rearwardly until hook 142's catch 146 is carried rearwardly of bar 140. As soon as hook 142's catch 146 is carried rearwardly of bar 140, hook 142's downward bias forces catch 146 downwardly between legs 134, 136. Any subsequent forward motion of pulley block 5 along cable 4 engages catch 146 against bar 140, preventing further forward motion of pulley block 5 and rider 7 along cable 4. Bracket 138 and hook 142 thus form a self-closing one-way latch which, when closed to engage catch 146 against bar 140 as aforesaid, prevents pulley block 5 from rolling forwardly along cable 4.

Figure 6B:
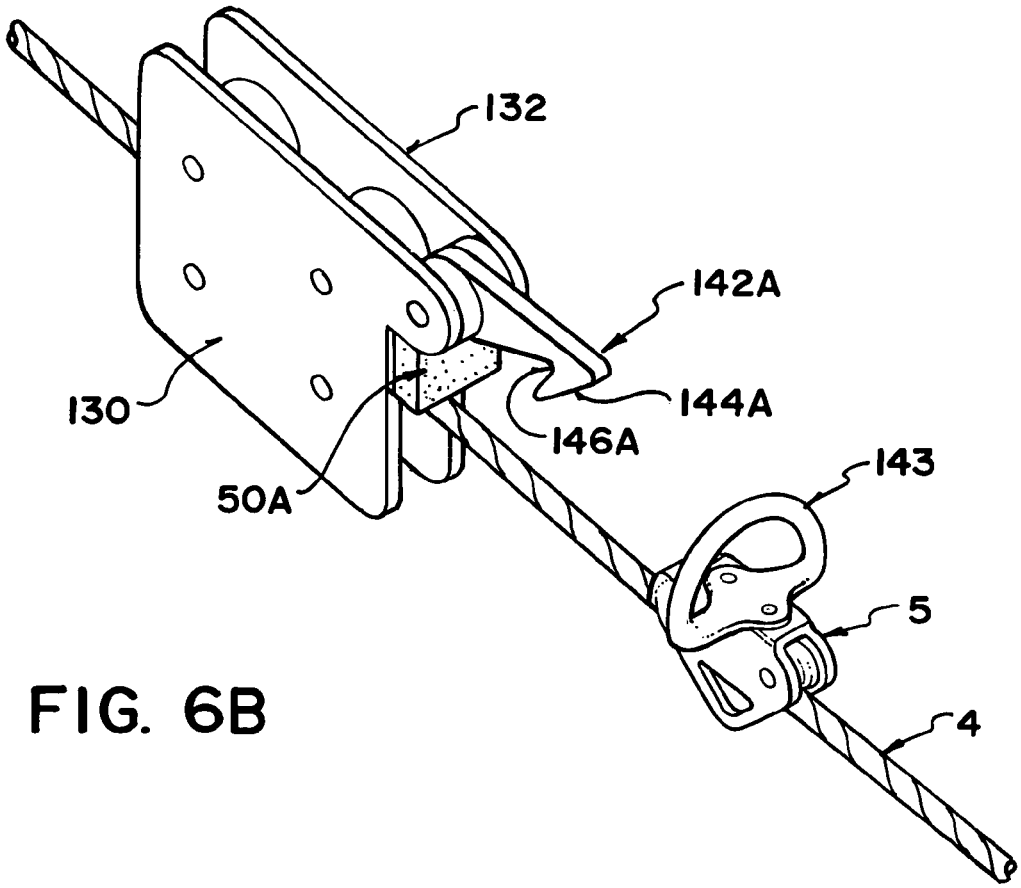
FIG. 6B is a schematic isometric view of a braking block in accordance with a third embodiment of the invention, showing a pulley block about to latchingly engage the braking block.
Figure 6A:
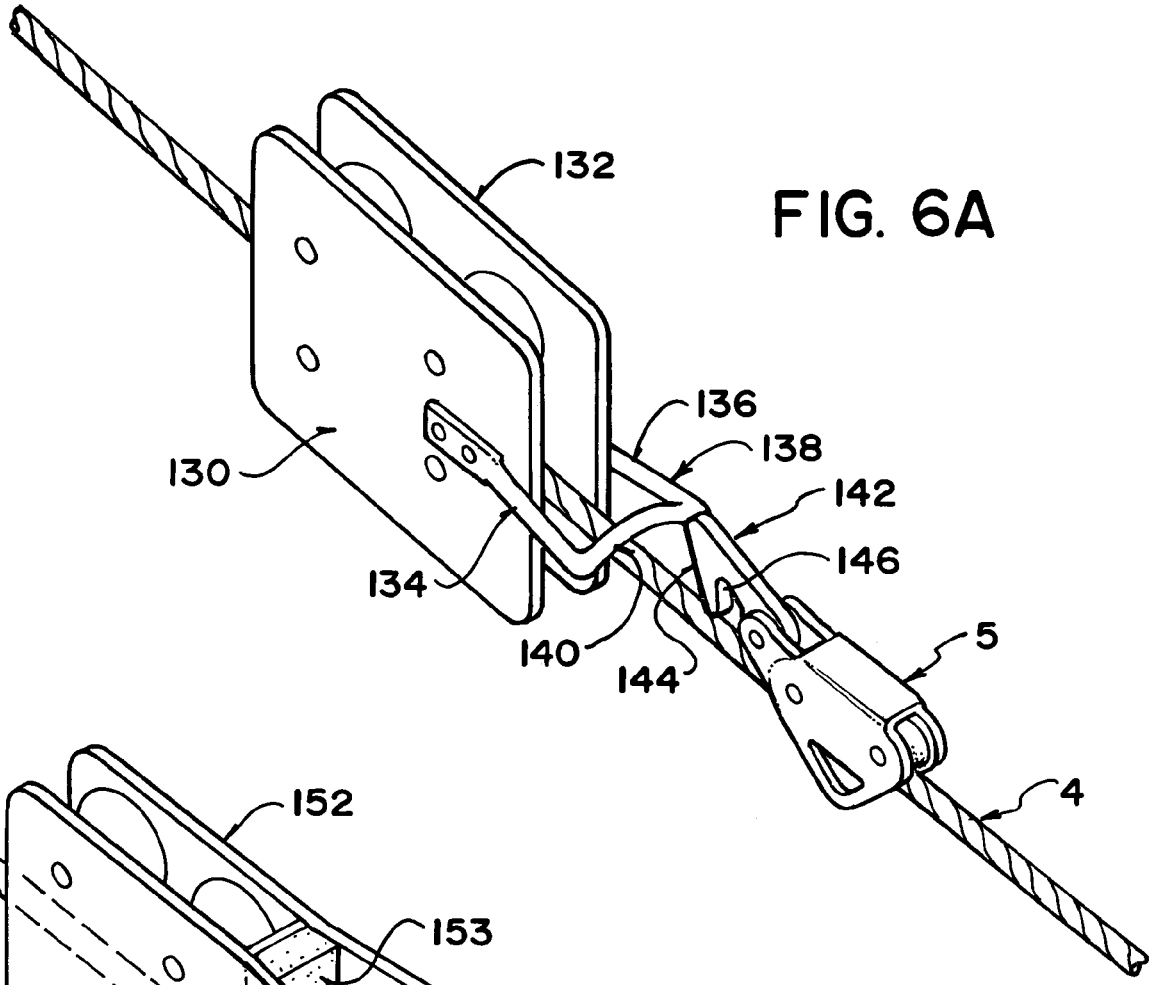
FIG. 6A is a schematic isometric view of a braking block in accordance with a third embodiment of the invention, showing a pulley block about to latchingly engage the braking block.

In the FIG. 6B embodiment, a pair of spaced-apart plates 130, 132 are rollably supported on opposite sides of cable 4 by pulleys to form a braking block. Hook 142A is pivotally fastened between plates 130, 132 forwardly of bumper block 50A, and projects forwardly of the braking block. Ring 143 is fastened atop pulley block 5. The weight of hook 142A downwardly biases hook 142A about its point of pivotal connection to the braking block. Alternatively, a spring (not shown) may be coupled between plates 130, 132 and hook 142A to downwardly bias hook 142A about its point of pivotal connection to the braking block. In operation of the FIG. 6B embodiment, pulley block 5 rolls rearwardly along cable 4 until ring 143 collides with hook 142A's downwardly biased, tapered forward underside 144A. The collision force overcomes hook 142A's downward bias, pivoting hook 142A upwardly and allowing pulley block 5 to continue rolling rearwardly until hook 142A's catch 146A is carried forwardly of ring 143. As soon as hook 142A's catch 146A is carried forwardly of ring 143, hook 142A's downward bias forces catch 146A downwardly over ring 143. Any subsequent forward motion of pulley block 5 along cable 4 engages ring 143 against catch 146A, preventing further forward motion of pulley block 5 and rider 7 along cable 4. Hook 142A and ring 143 thus form a self-closing one-way latch which, when closed to engage catch 146A against ring 143 as aforesaid, prevents pulley block 5 from rolling forwardly along cable 4.

Figure 7:
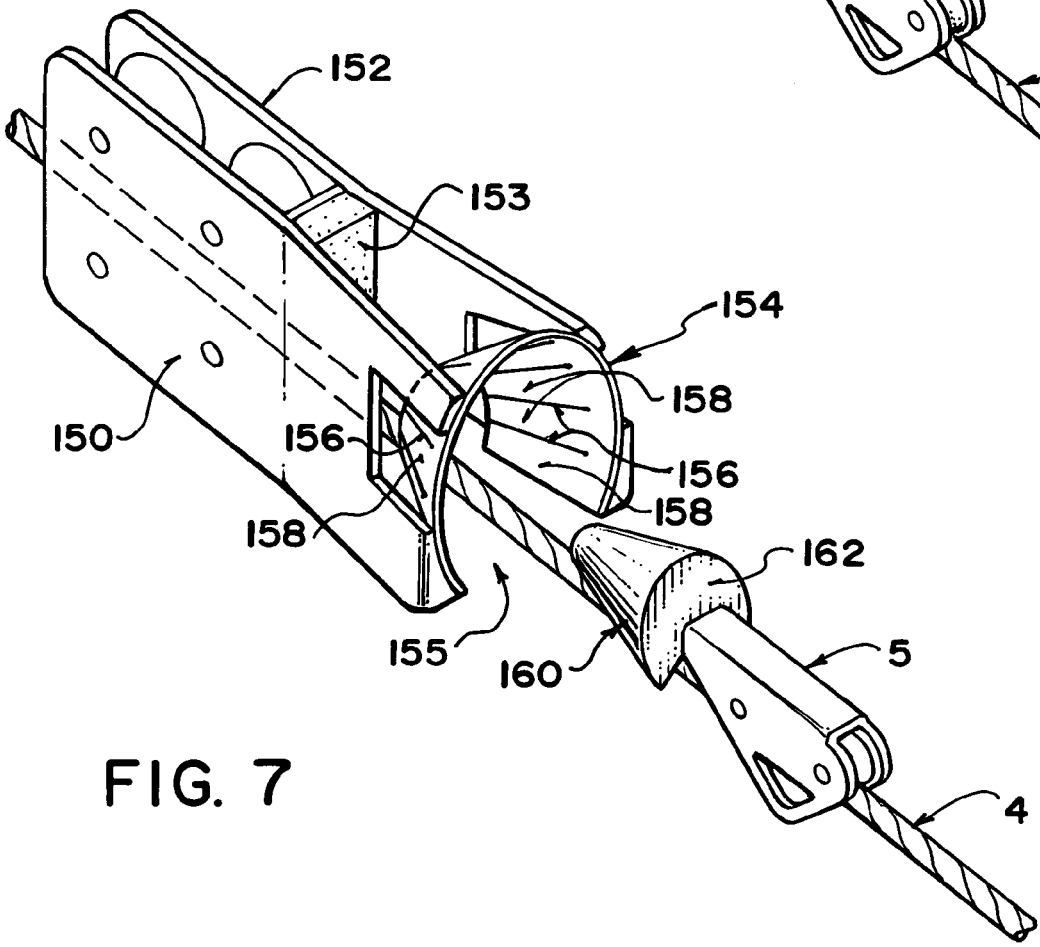
FIG. 7 is a schematic isometric view of a braking block in accordance with a fourth embodiment of the invention, showing a pulley block about to latchingly engage the braking block.

In the FIG. 7 embodiment, a pair of spaced-apart plates 150, 152 are rollably supported on opposite sides of cable 4 by pulleys (not shown) to form a braking block. Bumper block 153 is mounted between plates 150, 152. A semi-conical trap 154 is fastened between plates 150, 152 with the trap's wide, open forward end projecting forwardly of the braking block. The lower portion 155 of trap 154 is left open to allow pulley block 5 to roll through trap 154 as explained below. A plurality of longitudinal slits 156 are cut in trap 154. Each slit 156 extends from the trap's narrow, open rearward end toward but does not intersect the trap's wide, open forward end, thereby segmenting trap 154 into a plurality of spring blades 158. A bolt 160 having a rearwardly tapered semi-conical shape is fastened to and projects rearwardly from pulley block 5. In operation of the FIG. 7 embodiment, pulley block 5 rolls rearwardly along cable 4 until bolt 160 collides with trap 154. The collision force flexes spring blades 158 radially outwardly, allowing pulley block 5 to continue rolling rearwardly until bolt 160's forward face 162 is carried rearwardly of trap 154's rearward end. As soon as forward face 162 is carried rearwardly of trap 154's rearward end, spring blades 158 flex radially inwardly back to their original positions, positioning trap 154's rearward end against bolt 160's forward face 162, thereby preventing subsequent forward motion of pulley block 5 and rider 7 along cable 4. Trap 154 and bolt 160 thus form a self-closing one-way latch which, when closed to engage bolt 160's forward face 162 against trap 154's rearward end as aforesaid, prevents pulley block 5 from rolling forwardly along cable 4.

Figure 8:
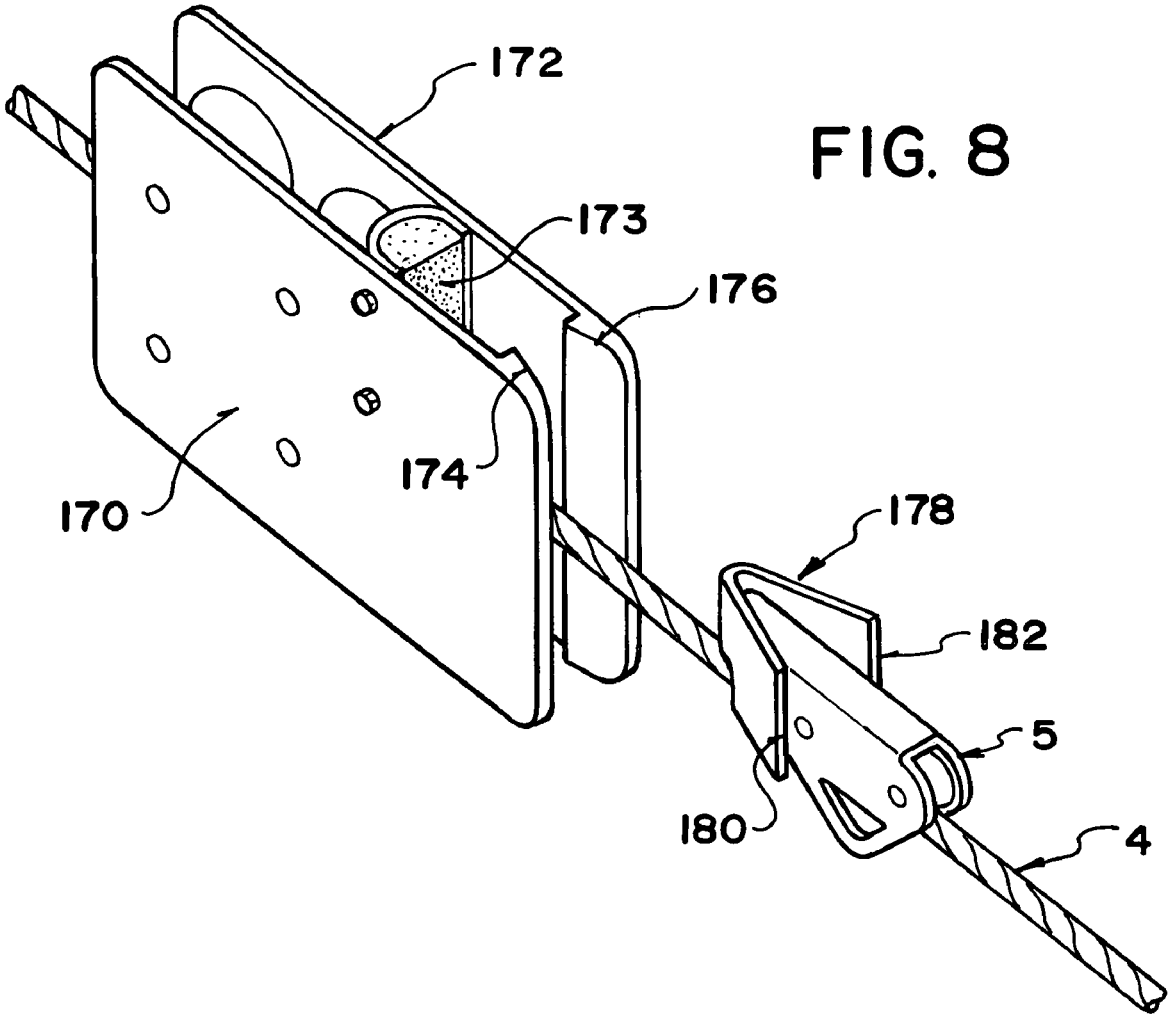
FIG. 8 is a schematic isometric view of a braking block in accordance with a fifth embodiment of the invention, showing a pulley block about to latchingly engage the braking block.

In the FIG. 8 embodiment, a pair of spaced-apart plates 170, 172 are rollably supported on opposite sides of cable 4 by pulleys (not shown) to form a braking block. Bumper block 173 is mounted between plates 170, 172. Rearwardly and inwardly tapered wedges 174, 176 are provided on the inward, forward ends of plates 170, 172 respectively. A V-shaped spring blade 178 is fastened to and projects rearwardly from pulley block 5. In operation of the FIG. 8 embodiment, pulley block 5 rolls rearwardly along cable 4 until spring blade 178 collides with the forward ends of plates 170, 172. The collision force flexes spring blade 178 inwardly toward cable 4, allowing pulley block 5 to continue rolling rearwardly until spring blade 178's forward ends 180, 182 are carried rearwardly of wedges 174, 176. As soon as forward ends 180, 182 are carried rearwardly of wedges 174, 176 spring blade 178 flexes radially outwardly back to its original position, positioning forward ends 180, 182 against the rearward ends 184, 186 of wedges 174, 176, thereby preventing subsequent forward motion of pulley block 5 and rider 7 along cable 4. Wedges 174, 176 and spring blade 178 thus form a self-closing one-way latch which, when closed to engage forward ends 180, 182 against rearward ends 184, 186 as aforesaid, prevents pulley block 5 from rolling forwardly along cable 4.

As will be apparent to those skilled in the art in the light of the foregoing disclosure, many alterations and modifications are possible in the practice of this invention without departing from the scope thereof. For example, struts 8 and crossbar 26 depicted in FIGS. 1 and 2 can be omitted. In their place, a separate cable (not shown) can be extended transversely across and above main cable 4, and one of pulleys 9 rotatably mounted on the separate cable to receive braking line 10 as aforesaid. Accordingly, the scope of the invention is to be construed in accordance with the substance defined by the following claims.

What is claimed is:

1. An apparatus for a zipline riding system comprising:

a rider block coupled to a zipline cable for movement in a rearward direction along the cable;

a connector for connecting the rider to the rider block for movement along the cable therewith;

a deceleration system comprising:

(a) a first frame mounted on the cable for movement of the first frame along the cable;

(b) a latch at a forward end of the first frame for engaging the rider block upon interception thereof; and (c) a braking line coupled to the first frame for exerting decelerating force on the first frame and thereby decelerating the rider as the first frame and the rider block move rearwardly along the cable.

2. An apparatus as defined in claim 1, wherein the latch is self-closing.

3. An apparatus as defined in claim 2, wherein the latch further comprises first and second capture plates inwardly biased toward one another on opposite sides of the cable.

4. An apparatus as defined in claim 3, further comprising a second frame coupled to the first frame, and wherein the first and second capture plates are mounted on a forward end of the second frame to form a corral between the first frame and the first and second capture plates.

5. An apparatus as defined in claim 4, the second frame further comprising a narrow rearward end and a wide forward end, the narrow and wide ends of the second frame together forming a first "V" longitudinally aligned with and straddling the cable, and wherein the first and second capture plates are mounted on the wide forward end of the second frame.

6. An apparatus as defined in claim 5, wherein the first and second capture plates form a second "V" longitudinally aligned with and straddling the cable, the second "V" having a narrow rearward end and a wide forward end, and wherein the narrow rearward end of the second "V" is located rearwardly of the wide forward end of the second "V".

7. An apparatus as defined in claim 3, wherein the first and second capture plates are pivotally coupled to the first frame.

8. An apparatus as defined in claim 7, wherein the first and second capture plates further comprise inwardly extending forward ends, wherein the apparatus further comprises a latch plate on the rider block, the latch plate having a rearwardly tapered rearward end and a notch on each outward side of the latch plate and wherein the inwardly extending forward ends of first and second capture plates are shaped for engagement within respective ones of the notches.

9. An apparatus as defined in claim 7, wherein the first and second capture plates further comprise inwardly extending forward ends, wherein the apparatus further comprises outwardly extending first and second hooks on a rearward end of the rider block and wherein the inwardly extending forward ends of the first and second capture plates are shaped for engagement within respective ones of the first and second hooks.

10. An apparatus as defined in claim 1, the first frame further comprising first and second spaced-apart plates rollably supported on opposite sides of the cable, the apparatus further comprising a bracket fastened between the first plate and the second plate, the bracket having a bar projecting forwardly of the plates, and a hook pivotally fastened to and projecting rearwardly from the rider block, the hook having a catch latchably engageable with the bar.

11. An apparatus as defined in claim 1, the first frame further comprising first and second spaced-apart plates rollably supported on opposite sides of the cable, the apparatus further comprising a hook pivotally fastened to and projecting forwardly of the first and second plates, and a ring fastened to the rider block, wherein the hook has a catch that is latchably engageable with the ring.

12. An apparatus as defined in claim 1, the first frame further comprising first and second spaced-apart plates rollably supported on opposite sides of the cable, the apparatus further comprising a semi-conical trap fastened between the first plate and the second plate, the trap having an open forward end projecting forwardly of the plates and having a plurality of spring blade segments, and a rearwardly tapered semi-conical bolt fastened to and projecting rearwardly from the rider block, the bolt having a forward face latchably engageable with a rearward end of the trap.

13. An apparatus as defined in claim 1, the first frame further comprising first and second spaced-apart plates rollably supported on opposite sides of the cable, the apparatus further comprising a first rearwardly and inwardly tapered wedge on an inward, forward end of the first plate and a second rearwardly and inwardly tapered wedge on an inward, forward end of the second plate, and a V-shaped spring blade fastened to and projecting rearwardly from the rider block, the spring blade having first and second forward ends latchably engageable with first and second rearward ends of the first and second wedges respectively.

14. An apparatus for a zipline riding system comprising:

a rider block coupled to a zipline cable for movement in a rearward direction along the cable;

a connector for connecting the rider to the rider block for movement along the cable therewith;

a latch moveably coupled to the cable for latching to the rearwardly moving rider block at a location spaced forwardly along the cable from a rearward end thereof;

a deceleration mechanism coupled to the latch for decelerating the latch and the rearwardly moving rider block latched thereto, as the latch and the rider block move rearwardly from the forwardly spaced location toward the rearward end of the cable.

15. An apparatus according to claim 14 wherein the latch, upon latching to the rearwardly moving rider block, is operative to prevent forward movement of the rider block relative to the latch.

16. An apparatus according to claim 15 wherein the latch comprises a first latch component for latching to a second latch component, the second latch component located on the rider block.

17. An apparatus according to claim 16 wherein the first latch component comprises a hook.

18. An apparatus according to claim 16 wherein the second latch component comprises a hook.

19. An apparatus according to claim 14 wherein the latch comprises one or more pulleys for rolling movement of the latch along the cable.

20. An apparatus for a zipline riding system comprising:

a rider block coupled to a zipline cable for movement in a rearward direction along the cable;

a connector for connecting the rider to the rider block for movement along the cable therewith;

a braking block moveably mounted to the cable for intercepting the rearwardly moving rider block at an initial location spaced apart from rearward and forward ends of the cable and for moving rearwardly along the cable with the rider block; and a braking line coupled to the braking block at a first one of its ends extending from the braking block through a braking means and back from the braking means to the braking block, where the braking line is coupled to the braking block at a second one of its ends;

wherein the braking means exerts decelerating force on the braking line, thereby decelerating the braking block and the rider block as the braking block and the rider block move rearwardly along the cable from the initial location toward the rearward end of the cable.

21. An apparatus according to claim 20 wherein the braking block comprises a latch for latching to the rider block upon interception thereof to prevent forward movement of the rider block relative to the braking block.

22. An apparatus according to claim 20 comprising a pulley system having one or more pulleys, the braking line extending through the pulley system between the first and second ends of the braking line.

23. An apparatus according to claim 20 wherein the braking means comprises a human operator applying friction to the braking line.

24. An apparatus according to claim 20 comprising a one way mechanism through which the braking line extends, the one way mechanism located between the first and second ends of the braking line, the one way mechanism allowing movement of the braking line in one direction but preventing movement of the braking line in an opposing direction.

* * * * *